US006332589B1

(12) United States Patent
Möller et al.

(10) Patent No.: US 6,332,589 B1
(45) Date of Patent: Dec. 25, 2001

(54) WINDING MACHINE HAVING CONTINUOUS LOOP AND TENSION DEVICE AND PROCESS FOR USING WINDING MACHINE

(75) Inventors: Roland Möller, Herbrechtingen; Werner Leitenberger, Schlier; Jörg Maurer, Steinheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/421,875

(22) Filed: Oct. 21, 1999

(30) Foreign Application Priority Data

Oct. 22, 1998 (DE) ..... 198 48 815

(51) Int. Cl.[7] ..... B65H 18/14
(52) U.S. Cl. ..... 242/541.3
(58) Field of Search ..... 242/541.3; 198/847; 474/148, 150, 153, 154, 155, 238, 261, 265, 270, 271

(56) References Cited

U.S. PATENT DOCUMENTS

| | | | | |
|---|---|---|---|---|
| 2,343,367 | * | 3/1944 | Conradson | 474/270 X |
| 2,442,037 | * | 5/1948 | Carter et al. . | |
| 2,446,310 | * | 8/1948 | Steinke . | |
| 3,791,602 | * | 2/1974 | Isakson | 242/541.3 |
| 4,143,828 | * | 3/1979 | Braun et al. | 242/541.3 |
| 4,196,865 | * | 4/1980 | Patriksson | 242/541.3 |
| 4,283,023 | * | 8/1981 | Braun et al. | 242/541.3 |
| 5,150,850 | | 9/1992 | Adams . | |
| 5,531,396 | * | 7/1996 | Kinnunen et al. | 242/541.3 X |
| 5,658,655 | * | 8/1997 | Stanhope | 474/265 X |
| 5,782,426 | * | 7/1998 | Kinnunen et al. . | |
| 5,785,273 | | 7/1998 | Wolf et al. . | |
| 5,832,696 | * | 11/1998 | Nagy et al. | 242/541.3 X |
| 5,860,883 | * | 1/1999 | Jonen et al. | 474/271 X |
| 5,878,975 | * | 3/1999 | Stone et al. | 242/541.3 X |
| 5,891,561 | * | 4/1999 | Kinoshita et al. | 474/271 X |
| 5,918,830 | * | 7/1999 | Verajankorva et al. | 242/541.3 X |

FOREIGN PATENT DOCUMENTS

| | | | |
|---|---|---|---|
| 2227302 | | 7/1998 | (CA) . |
| 498962 | * | 5/1930 | (DE) . |
| 2721881 | | 11/1978 | (DE) . |
| 2917769 | | 11/1979 | (DE) . |
| 2908294 | | 9/1980 | (DE) . |
| 3501635 | | 7/1986 | (DE) . |
| 51988 | | 10/1989 | (DE) . |
| 4214713 | | 11/1992 | (DE) . |
| 19745005 | | 7/1998 | (DE) . |
| 658504 | | 6/1995 | (EP) . |
| 728691 | * | 8/1996 | (EP) . |
| 765832 | * | 4/1997 | (EP) . |
| 2009108 | * | 6/1979 | (GB) . |
| 2021077 | | 11/1979 | (GB) . |

* cited by examiner

*Primary Examiner*—William A. Rivera
(74) *Attorney, Agent, or Firm*—Greenblum & Bernstein, P.L.C.

(57) ABSTRACT

Winding machine and process for producing at least one wound roll from a supplied material web. The winding machine includes a core formed by a tube, on which the material web is rolled into a wound roll, and at least one winding gap, which regulates the winding tightness formed between the core and the wound roll originating thereon. The winding machine also includes at least one winding roller, and at least one pre-tensioned continuous loop encircling at least one winding roller. The process includes passing the material web over at least one pre-tensioned continuous loop encircling at least one winding roller, the material web being one of paper or cardboard, and regulating the winding tightness of the at least one wound roll with a winding gap between a winding roll and the material web or a core, comprising a tube. The process further includes winding the at least one wound roll on the core, wherein the tension of the at least one pre-tensioned continuous loop is adjusted by at least one tensioning device.

66 Claims, 3 Drawing Sheets

WINDING MACHINE HAVING CONTINUOUS LOOP AND TENSION DEVICE AND PROCESS FOR USING WINDING MACHINE

CROSS-REFERENCE TO RELATED APPLICATIONS

The present application claims priority under 35 U.S.C. § 119 of German Patent Application No. 198 48 815.7, filed on Oct. 22, 1998, the disclosure of which is expressly incorporated by reference herein in its entirety.

BACKGROUND OF THE INVENTION

1. Field of the Invention

The present invention relates to a winding machine for producing at least one wound roll from a supplied material web, such as a paper or endless cardboard web, in which the material web or the web sections generated therefrom are each wound on a core formed by a tube or the like. The invention further includes a continuous loop encircling at least one winding roller and a tensioning device with at least one winding gap that regulates the winding tightness of the wound roll of material web.

2. Discussion of Background Information

The winding rollers used in the paper industry are in most cases manufactured from steel or gray cast iron. The so-called functional surface of this type of winding roller, i.e., where the roller sleeve contacts the wound roll, is generally covered with a hard coating. Current developments in paper manufacturing are now increasingly tending toward more sensitive paper, higher web speeds, and larger winding diameters. This can cause, amongst other things, air problems, such as the formation of bubbles, winding defects, too high a tension level that is nip-induced, and layer shifts. In order to counter these problems, winding rollers are more and more frequently covered with soft coatings. This type of winding roller is typically composed of a basic metal body and a coating that has either been vulcanized or glued onto it. However, a disadvantage of such winding rollers is that, amongst other things, the soft coatings have a relatively short service life. Furthermore, soft roller coatings are expensive and applying them is very time-consuming. For example, the residue of the old coating must be removed initially and appropriate preparations must be undertaken before the new coating can ultimately be applied. Apart from these disadvantages resulting from the requirement for a coating, the time needed to change a respective roller is normally also very great. Thus, at least one spare roller having the same coating must be made available.

As used herein, the term "soft" is meant to encompass a range of softness as described in Pussy & Jones (P&J). If expressed in terms of ranges, what is meant by the term soft is the range from about 80 P&J to about 105 P&J, more preferably from about 85 P&J to about 100 P&J, and most preferably from about 90 P&J to about 95 P&J. If, on the other hand, the term soft is expressed in terms of upper and lower values, the upper values are about 105 P&J, and they are preferably less than 105 P&J, more preferably less than 100 P&J, and most preferably less than 95 P&J. On the lower side, the lower values are about 80 P&J, and they are preferably greater than 80 P&J, more preferably greater than 85 P&J, and most preferably greater than 90 P&J.

In a paper machine known from DE-PS 51 988, the paper web is fed, amongst other things, through a roller press across whose upper press roller a continuous rubber blanket is fed. Another press roller is described in DE 35 01 635 A1, which incorporates a flexible press sleeve that is impervious to fluid, through which a supporting body that is positioned in a fixed or rotatable manner extends.

Nonetheless, these known rollers are not used to wind up a supplied material web or to re-roll an already finished wound roll.

SUMMARY OF THE INVENTION

A winding machine is provided, according to the invention, for producing at least one wound roll from a supplied material web. The winding machine includes a core formed by a tube, on which the material web is rolled into a wound roll, and at least one winding gap, which regulates the winding tightness formed between the core and the wound roll originating thereon. The winding machine disclosed herein also includes at least one winding roller, and at least one pre-tensioned continuous loop encircling at least one winding roller.

In the winding machine disclosed the core may be formed by a tube, a rod, or the like, and the material web may be a web of paper or of cardboard.

In this invention, the continuous loop may take two forms. The continuous loop may extend either essentially across the entire width of the winding roller, or there may be more than one continuous loop with each continuous loop extending only across a portion of the winding roller, and placed adjacent to each other to extend essentially across the width of the winding roller.

Additionally, the continuous loop may have various properties. The continuous loop may be either soft at least on its exterior or entirely soft and/or flexible. Further, the continuous loop may be in the form of either: a flat belt comprising an internal run layer, a tension layer, and an external outer layer with a soft coating; a V-belt, with a soft coating, within a circumferential channel; or an internal run layer and an external layer with a soft coating.

On the winding machine described, the continuous loop may have soft coatings, such as rubber, and the coating may have a structural surface or surfaces. The structural surface may be grooves, or it may be a soft porous coating. Further, the continuous loop may be covered with a soft rubber coating having embedded hollow spaces.

In this invention, it is contemplated that the tension of the continuous loop may be adjustable. The tension is adjusted by at least one tensioning device located within the continuous loop.

The winding machine described herein is further comprised of at least one winding roller, with a metallic sleeve, which serves as a main roll or a support roll to at least one core and wound roll.

The winding machine disclosed herein further comprises at least one moveable winding roller and at least one movable tensioning device, with both the winding roller and the tensioning device being jointly adjustable. In addition, a winding machine is also disclosed in which at least one stationary winding roller and at least one stationary tensioning device is utilized.

According to the invention, the winding machine may be used in a process for producing at least one wound roll from a material web. The process includes passing the material web over at least one pre-tensioned continuous loop encircling at least one winding roller, the material web being one of paper or cardboard, and regulating the winding tightness of the at least one wound roll with a winding gap between a winding roll and the material web or a core, comprising a tube. The process disclosed herein further includes winding the at least one wound roll on the core, wherein the tension of the at least one pre-tensioned continuous loop is adjusted by at least one tensioning device.

BRIEF DESCRIPTION OF THE DRAWINGS

The present invention is further described in the detailed description which follows, in references to the noted plurality of drawings, by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
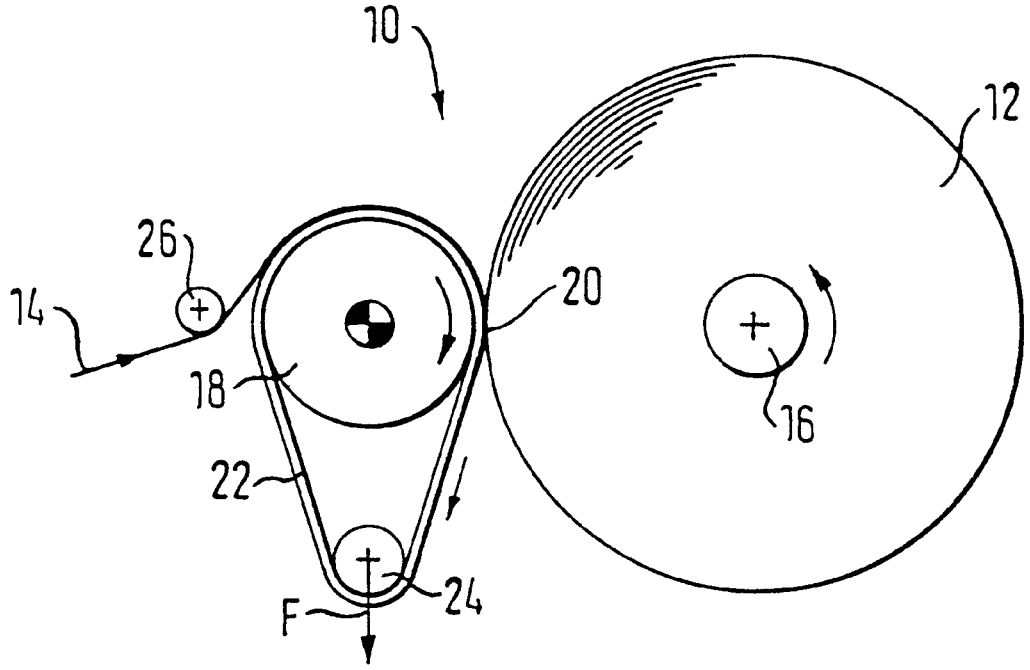
FIG. 1 is a schematic representation of a first embodiment of a winding machine.

The particulars shown herein are examples and for purposes of illustrative discussion of the embodiments of the present invention only and are presented for the sole purpose of providing what is believed to be the most useful and readily understood description of the principles and conceptual aspects of the present invention. In this regard, no attempt is made to show structural details of the present invention in more detail than is necessary for the fundamental understanding of the present invention. The description in combination with the drawings are intended to make apparent to those skilled in the art how the several forms of the present invention may be embodied in practice.

The invention relates to a winding machine, of the type mentioned in the introduction, that is as cost-effective as possible and that is kept simple in terms of structure, thereby eliminating the aforementioned problems.

The invention accomplishes this in that at least one pre-tensioned continuous loop encircles at least one winding roller.

Based on this embodiment, the functional surface contacting the winding roller is no longer formed by a corresponding coating of the winding roller, but by the continuous loop instead. As a result, it is no longer necessary for the winding roller to be covered with any special coating. Accordingly, after a certain amount of wear occurs, only the continuous loop, rather than the winding roller itself, must be replaced, which is considerably more time-effective and efficient. Beyond this, even in the case of damage, i.e., when the soft coating bums, only the loop and not the roller or drum has to be replaced. However, replacing the respective loop can also require the removal of the roller, or that it be cantilevered at a minimum. In any event, a loop can be replaced much more quickly than a roller. Further, the requirement of maintaining an expensive coated spare winding roller is also eliminated.

In addition, the loop can assume other functions within the machine. Thus, in the case of an embodiment on a Pope-type roller, for example, a discharging strand can be used to divert the web into a pulper, thereby eliminating the need for a doctor. Furthermore, a higher level of safety is achieved as compared with the use of a doctor. Particularly in the case of paper reel slitting machines, an accumulating strand can also be used to produce webs. Moreover, various coatings can be tested more easily. The behavior or the properties of the loop on the winding roller can be regulated by means of the loop tension. That is, the invention can be used to control winding tightness in the case of all winding machines with roller nips generating a specific line load. The winding machine according to the invention can also be used to re-roll a wound roll that has already been finished.

In an embodiment of the winding machine according to the invention, the continuous loop is designed to be soft, at least on its exterior. It is preferred, however, that the continuous loop be entirely soft and/or flexible. As a result, the loop can be softer than the sleeve of the winding roller.

In most applications, the continuous loop should extend at least essentially across the entire machine width.

It is preferred for the tension of the continuous loop to be adjustable; therefore, a tensioning device is included in the loop assembly. The tensioning device should be situated inside the continuous loop.

In a practical embodiment, the tensioning device includes at least one adjustable tension roller.

It is preferred for the winding roller to have a metallic sleeve, and the winding roller may serve as both a main roll or a support roll.

In certain applications, at least two winding rollers are utilized as support rolls for at least one core or wound roll.

A respective winding roller can be stationary or movable.

In a practical embodiment, a stationary tensioning device is employed within a continuous loop encircling the stationary winding roller.

Conceivably, a movable tensioning device may be utilized in conjunction with the continuous loop encircling a moveable winding roller; both the winding roller and the tensioning device are preferably adjustable in this case.

As previously mentioned, the continuous loop can also carry out other functions in principle. For example, it can be advantageous, in certain cases, to employ at least one continuous loop looping around at least one winding roller so that the continuous loop is used to divert the material web into a pulper.

In specific applications, it is also advantageous for at least one continuous loop looping around at least one winding roller to be provided, through which loop the strand accumulating on the winding roller can produce the material web or at least one of the web sections generated from it.

In connection with paper reel slitting machines, the invention can be used in assemblies comprising two-drum winders with several support rolls or support roll winders with several support rolls.

Other exemplary embodiments and advantages of the present invention may be ascertained by reviewing the present disclosure and the accompanying drawings.

FIG. 1 shows a purely schematic representation of a winding machine 10, which is used for producing a wound roll 12 from a supplied material web 14. The material web 14 can be a paper web, cardboard web, or the like.

The material web 14 is wound on a core 16 formed by a tube or the like. A winding gap 20 that regulates winding tightness exists between the core 16 and the wound roll 12 originating thereon.

As can be seen from the figure, the winding roller is propelled, such that the wound roll 12 formed on the core 16 is correspondingly rotated along with the winding roller.

A pre-tensioned continuous loop 22 encircling at least one winding roller 18, with the continuous loop designed to be soft on its exterior, faces the material web 14 and the wound roll 12. In the case at hand, an entirely soft and/or flexible continuous loop 22 is utilized. As a result, the flexible loop 22 can be softer than the sleeve of the winding roller 18. In the present embodiment, the winding roller 18 has a metallic sleeve.

The continuous loop 22 may extend at least essentially across the entire machine width. It is preferred that the loop tension be adjustable. For this purpose, a tensioning device 24 is situated inside the continuous loop; the tensioning devise may be a tension roller or the like.

As can be seen in FIG. 1, the continuous loop 22 extends generally downwardly starting from the winding roller 18. In so doing, a tensioning device 24 which may be in the form of a tension roller, for example, is arranged in the lower area of the loop. As indicated by arrow F, the continuous loop 22 is stressed downwardly by the tensioning device 24.

The material web 14 can be diverted into a pulper by means of the strand of the continuous loop 22 discharging from the winding roller 18.

As a result, the embodiment shown can be a type of Pope-type roller.

The winding roller 18 can be stationary or movable. In the case of a movable winding roller 18, the tensioning device 24 should also be movable, with the main roll 18 and the tensioning device being preferably jointly moveable or adjustable.

As can be seen from FIG. 1, the material web 14 is fed by means of a deflection roller, such as an expander roller 26 or the like, across and around the continuous loop 22, which encircles the winding roller 18. Thereafter, the material web 14 is fed together with the continuous loop 22 through the winding gap 20. The wound roll 12 can be generated on the core 16.

Figure 2:
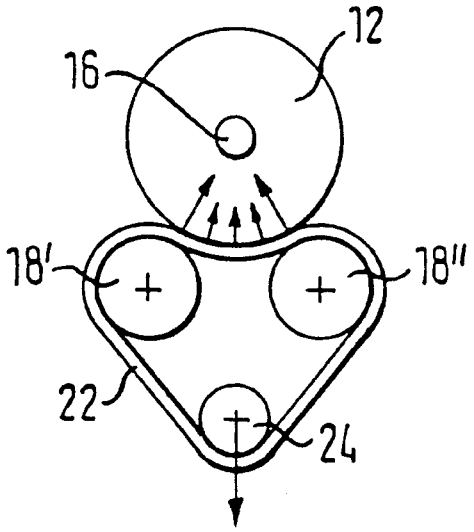
FIG. 2 is a partial schematic representation of another embodiment of a winding machine.

FIG. 2 shows another embodiment of a winding machine in a partial schematic representation. In this case, two winding rollers 18', 18" serve as support rolls for the core 16 or wound roll 12; these winding rollers are arranged within a common continuous loop 22 pre-tensioned by a tensioning device 24. The two winding rollers 18', 18" are located at a distance from one another, with the continuous loop 22 assuming a support function between these winding rollers 18', 18", thereby making an additional winding surface available.

Figure 3:
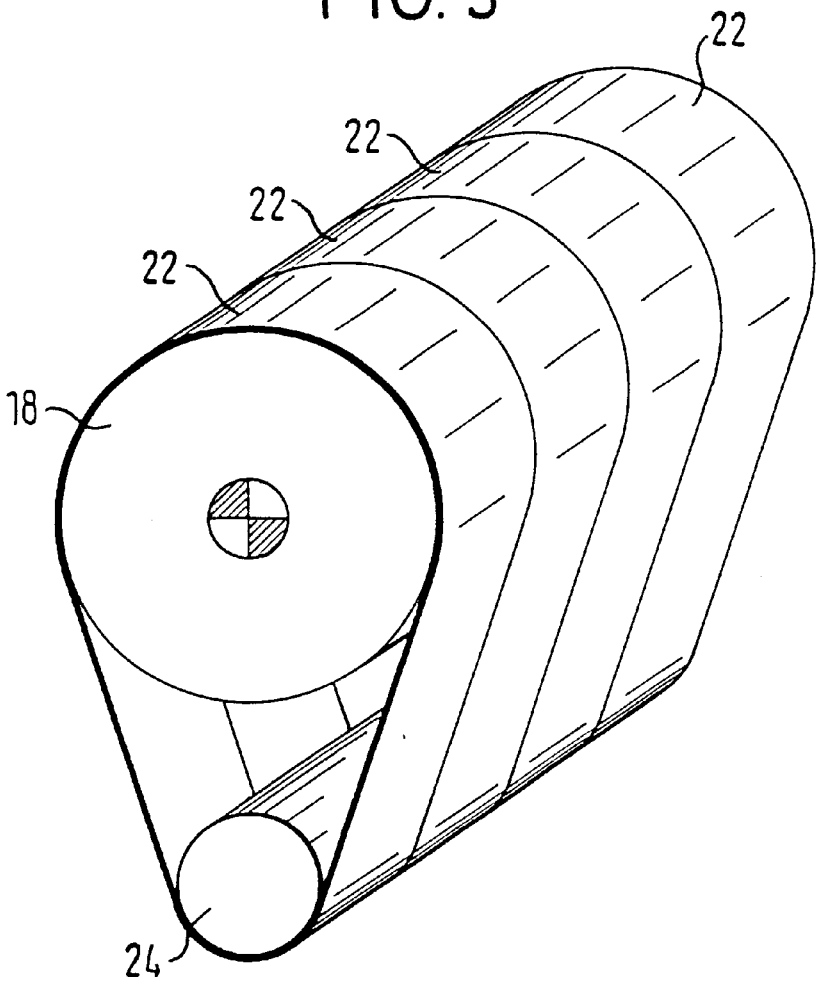
FIG. 3 is a partial schematic representation of another embodiment of a winding machine.

As can be seen in FIG. 3, instead of a loop that is as wide as the winding roller, several narrower loops 22 extending only across a portion of the winding roller width can also be arranged next to one another in the direction of the width. The loops 22 are mounted in such a way that at most a very slight gap occurs between them. The loops 22 can also be laterally adjacent to one another even without an intermediate gap. The advantages of narrower loops 22, include easier assembly, simpler and less expensive manufacturing, and the fact that variations of parameters, such as the rubber hardness across the width of the web, can be realized more easily. In addition, the winding roller 18 and the tensioning device 24 are also evident again in FIG. 3.

Figure 4:
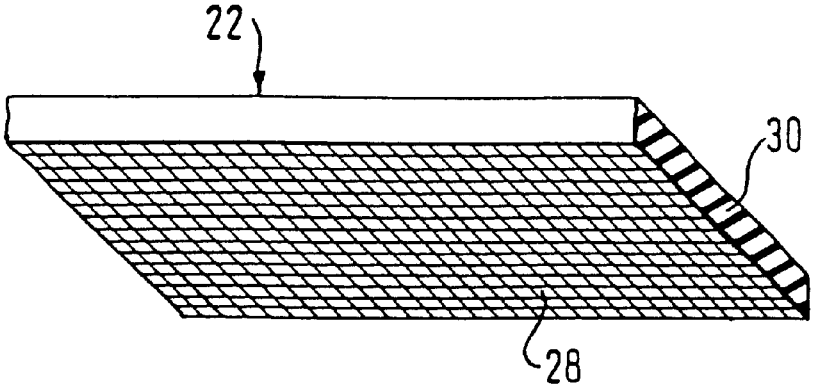
FIGS. 4 to 9 are partial schematic representations of partial sections of exemplary embodiments of the continuous loop.

As can be seen in FIG. 4, a respective loop 22 can include an internal run layer 28 facing the winding roller 18 and the tensioning device 24 (see also FIGS. 1 through 3) and an external soft coating 30 facing the web 14 and the wound roll 12.

The function of a run layer can be, amongst other things, to accommodate the loop tension (tensile stress); thus, relieving the soft coating from the loop tension. Further, the run layer can facilitate traction with the (driving) roller and serve as the connection with the soft coating. On the other hand, a soft coating is used as a structural surface for winding as well as to accommodate the transverse strain resulting from the winding process.

With respect to the run layer, a structure of functional layers similar to flexible drives is possible.

Figure 5:
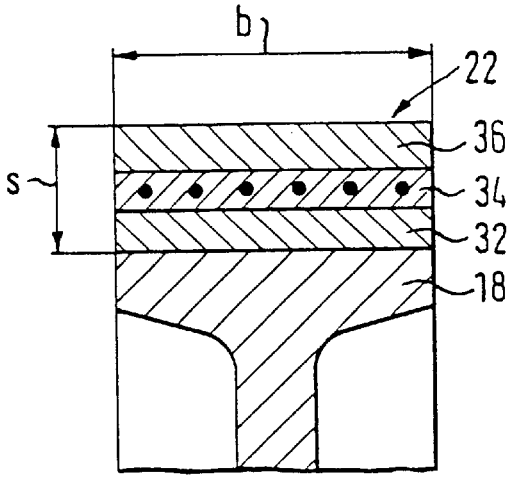

In the case of the embodiment illustrated in FIG. 5, the continuous loop 22 having dimensions 's' and 'b' is formed by a flat belt which includes an internal run layer 32, a tension layer 34, and an external outer layer 36 covered with a soft coating. In addition, the winding roller 18, which is disk-like in the present embodiment, is also shown in FIG. 5. The run layer 32 can be used to produce traction with a specific roller 18, the tension layer 34 can be used to accommodate the loop tension, and the outer layer 36 serves as the connection with the soft coating. The tension layer 34 can be partially formed by fibers that are resistant to stretching or by a metal band.

Figure 6:
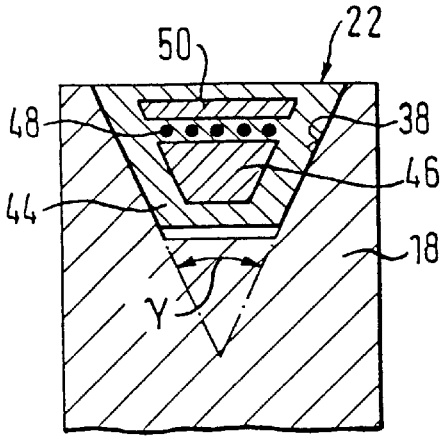

In the case of the embodiment depicted in FIG. 6, the continuous loop 22 is formed by a V-belt with a soft coating inserted in a circumferential channel 38. The V-belt design ensures centering of the loop 22 with respect to the winding roller 18. As can be seen in FIG. 6, the V-belt or the loop 22 within a sheathing 44 can include a core 46, a tension rope 48 and/or a support 50. The two side walls of the V-shape enclose an angle $\gamma$, which lies in a range of approximately 50° in the case at hand.

Figure 7:
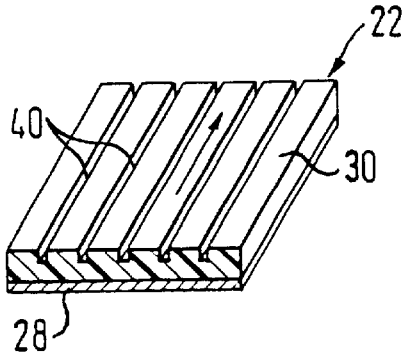

In the embodiment shown in FIG. 7, structural surfaces are built into the external soft coating 30 of loop 22; the coating is composed of rubber and located on the internal run layer 28. The soft coating 30 is grooved 40 in the case at hand.

The soft coating 30 can, for example, be composed of rubber. This type of rubber can be incompressible or constant in terms of volume and have a value $\mu$ of approximately 0.5 for example.

Figure 8:
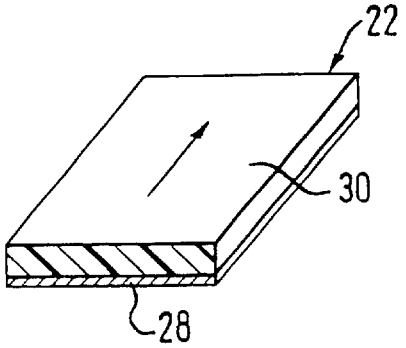

According to FIG. 8, a porous soft coating 30 can also be placed on the internal run layer 28 of the loop 22. This type of soft coating 30 is compressible, with a specific compression resulting in a corresponding reduction in volume. As a result, this soft coating 30 can also be a type of foamed material.

Figure 9:
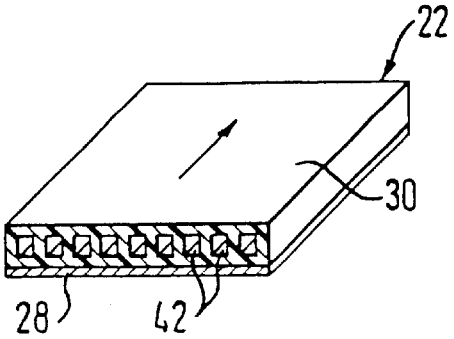

In the embodiment according to FIG. 9, the continuous loop 22 includes an internal run layer 28 and a soft coating 30, which is again composed of rubber and situated on the run layer. The soft coating is embedded with hollow spaces 42, which can also be subject to pressure. This type of soft coating 30 produces a function similar to a porous coating.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration and not words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Winding machine
12 Wound roll
14 Materialweb
16 Core
18 Winding roller
18' Winding roller
18" Winding roller
20 Winding gap
22 Continuous loop
24 Tensioning device
26 Expander roller
28 Internal run layer
30 External soft coating
32 Internal run layer
34 Tension layer
36 Outer layer
38 Circumferential channel
40 Grooves
42 Hollow spaces
44 Sheathing
46 Core
48 Tension rope
F Arrow

What is claimed:

1. A winding machine for producing at least one wound roll from a supplied material web, comprising:

at least one core formed by a tube, on which the material web is rolled into a wound roll;

at least one winding roller positioned adjacent one of said at least one core and said wound roll to form at least one winding gap for regulating winding tightness of said material web onto one of said at least one core and said at least one wound roll;

at least one pre-tensioned continuous loop encircling said at least one winding roller; and at least one tensioning device for regulating a tension of said at least one pre-tensioned continuous loop, wherein said at least one winding roller and said at least one tensioning device are movable and jointly adjustable.

2. The winding machine recited in claim 1, said material web comprising one of paper or cardboard.

3. The winding machine recited in claim 2, wherein the said at least one pre-tensioned continuous loop is soft at least on its exterior.

4. The winding machine recited in claim 3, wherein the said at least one pre-tensioned continuous loop extends at least essentially across the entire width of the winding roller.

5. The winding machine recited in claim 4, wherein the tension of the at least one pre-tensioned continuous loop is adjustable.

6. The winding machine recited in claim 5, wherein said at least one winding roller serves as one of a main roll and a support roll for said at least one core and said at least one wound roll.

7. The winding machine recited in claim 6, wherein said at least one winding roller has a metallic sleeve.

8. The winding machine recited in claim 3, wherein a softness of the exterior of the at least one pre-tensioned continuous loop is within a range of between 80 and 105 on the Pussy & Jones softness scale.

9. The winding machine recited in claim 8, wherein the softness of the exterior of said at least one pre-tensioned continuous loop is within a range of between 85 to 100 on the Pussy & Jones softness scale.

10. The winding machine recited in claim 8, wherein the softness of the exterior of said at least one pre-tensioned continuous loop is within a range of between 90 to 95 on the Pussy & Jones softness scale.

11. The winding machine recited in claim 2, wherein said at least one pre-tensioned continuous loop is at least one of entirely soft or flexible.

12. The winding machine recited in claim 11, wherein said at least one pre-tensioned continuous loop extends at least essentially across the entire width of the winding roller.

13. The winding machine recited in claim 12, wherein the tension of said at least one pre-tensioned continuous loop is adjustable.

14. The winding machine recited in claim 13, wherein said at least one winding roller serves as one of a main roll and a support roll for said at least one core and said at least one wound roll.

15. The winding machine recited in claim 14, wherein said at least one winding roller has a metallic sleeve.

16. The winding machine recited in claim 15, further comprising at least one tensioning device for regulating the tension of said at least one pre-tensioned continuous loop.

17. The winding machine recited in claim 16, wherein said at least one winding roller and said at least one tensioning device are movable and jointly adjustable.

18. The winding machine recited in claim 16, wherein said at least one winding roller and said at least one tensioning device are stationary.

19. The winding machine recited in claim 1, wherein said at least one winding roller and said at least one tensioning device are stationary.

20. The winding machine recited in claim 2, wherein the material web discharging from said at least one pre-tensioned continuous loop is diverted into a pulper.

21. The winding machine recited in claim 2, wherein said at least one pre-tensioned continuous loop further comprises an internal run layer and an external soft coating.

22. The winding machine recited in claim 21, wherein the soft coating is rubber.

23. The winding machine recited in claim 22, wherein the soft coating has embedded hollow spaces.

24. The winding machine recited in claim 21, wherein the soft coating comprises structural surfaces.

25. The winding machine recited in claim 21, said soft coating being grooved.

26. The winding machine recited in claim 21, wherein the soft coating is porous.

27. The winding machine recited in claim 21, wherein said at least one continuous loop comprises a plurality of continuous loops, each extending across a portion of the width of the said at least one winding roller, the continuous loops being arranged next to one another across the width of said at least one winding roller.

28. The winding machine recited in claim 21, wherein the tension of said at least one pre-tensioned continuous loop is adjustable.

29. The winding machine recited in claim 28, wherein said at least one winding roller serves as one of a main roll and a support roll for said at least one core and said at least one wound roll.

30. The winding machine recited in claim 29, wherein said at least one winding roller has a metallic sleeve.

31. The winding machine recited in claim 30, further comprising at least one tensioning device for regulating the tension of said at least one pre-tensioned continuous loop.

32. The winding machine recited in claim 31, wherein said at least one winding roller and said at least one tensioning device are movable and jointly adjustable.

33. The winding machine recited in claim 31, wherein said at least one winding roller and said at least one tensioning device are stationary.

34. The winding machine recited in claim 2, wherein said at least one pre-tensioned continuous loop comprises a flat belt further comprising an internal run layer, a tension layer, and an external soft coating.

35. The winding machine recited in claim 34, wherein the soft coating is rubber.

36. The winding machine recited in claim 35, wherein the soft coating has embedded hollow spaces.

37. The winding machine recited in claim 34, wherein the soft coating comprises structural surfaces.

38. The winding machine recited in claim 34, said soft coating being grooved.

39. The winding machine recited in claim 34, wherein the soft coating is porous.

40. The winding machine recited in claim 34, wherein said at least one continuous loop comprises a plurality of continuous loops, each extending across a portion of the width of the said at least one winding roller, the continuous loops being arranged next to one another across the width of said at least one winding roller.

41. The winding machine recited in claim 34, wherein the tension of said at least one pre-tensioned continuous loop is adjustable.

42. The winding machine recited in claim 41, wherein said at least one winding roller serves as one of a main roll and a support roll for said at least one core and said at least one wound roll.

43. The winding machine recited in claim 42, wherein said at least one winding roller has a metallic sleeve.

44. The winding machine recited in claim 43, further comprising at least one tensioning device for regulating the tension of said at least one pre-tensioned continuous loop.

45. The winding machine recited in claim 44, wherein said at least one winding roller and said at least one tensioning device are movable and jointly adjustable.

46. The winding machine recited in claim 44, wherein said at least one winding roller and said at least one tensioning device are stationary.

47. The winding machine recited in claim 2, said at least one pre-tensioned continuous loop comprises a V-belt, with a soft coating, within a circumferential channel.

48. The winding machine recited in claim 47, wherein the soft coating is rubber.

49. The winding machine recited in claim 48, wherein the soft coating has embedded hollow spaces.

50. The winding machine recited in claim 47, wherein the soft coating comprises structural surfaces.

51. The winding machine recited in claim 47, said soft coating being grooved.

52. The winding machine recited in claim 47, wherein the soft coating is porous.

53. The winding machine recited in claim 47, wherein said at least one continuous loop comprises a plurality of continuous loops, each extending across a portion of the width of the said at least one winding roller, the continuous loops being arranged next to one another across the width of said at least one winding roller.

54. The winding machine recited in claim 47, wherein the tension of said at least one pre-tensioned continuous loop is adjustable.

55. The winding machine recited in claim 54, wherein said at least one winding roller serves as one of a main roll and a support roll for said at least one core and said at least one wound roll.

56. The winding machine recited in claim 55, wherein said at least one winding roller has a metallic sleeve.

57. The winding machine recited in claim 56, further comprising at least one tensioning device for regulating the tension of said at least one pre-tensioned continuous loop.

58. The winding machine recited in claim 57, wherein said at least one winding roller and said at least one tensioning device are movable and jointly adjustable.

59. The winding machine recited in claim 57, wherein said at least one winding roller and said at least one tensioning device are stationary.

60. The winding machine recited in claim 2, wherein said at least one wound roll constitutes a material web.

61. A winding machine for producing at least one wound roll from a supplied material web, comprising:

at least one core formed by a tube, on which the material web is rolled into a wound roll, the material web being one of paper or cardboard;

at least one winding roller positioned adjacent one of said at least one core and said wound roll to form at least one winding gap for regulating winding tightness of said material web onto said at least one core and said at least one wound roll;

said at least one winding roller having a metallic sleeve;

at least one pre-tensioned continuous loop, which extends at least essentially across the entire width of said at least one winding roller, encircling said at least one winding roller, the tension of said at least one continuous loop being adjustable; and at least one tensioning device for regulating the tension of said at least one pre-tensioned continuous loop, wherein said at least one winding roller serves as one of a main roll and a support roll for said at least one core and said at least one wound roll.

62. The winding machine recited in claim 61, wherein said at least one pre-tensioned continuous loop comprises a soft exterior surface having a softness within a range of between 80 and 105 on the Pussy & Jones softness scale.

63. The winding machine recited in claim 62, wherein the softness of the exterior of said at least one pre-tensioned continuous loop is within a range of between 85 to 100 on the Pussy & Jones softness scale.

64. The winding machine recited in claim 62, wherein the softness of the exterior of said at least one pre-tensioned continuous loop is within a range of between 90 to 95 on the Pussy & Jones softness scale.

65. A process for producing at least one wound roll from a material web, the process comprising:

passing the material web over at least one pre-tensioned continuous loop encircling at least one winding roller;

regulating the winding tightness of said at least one wound roll with a winding gap formed between said at least one winding roll and one of said at least one wound roll and a core on which said at least one wound roll is to be formed;

winding said at least one wound roll on said core; and adjusting the tension of said at least one pre-tensioned continuous loop by at least one tensioning device, wherein said at least one winding roller and said at least one tensioning device are movable and jointly adjustable.

66. The process recited in claim 65, further comprising:

supporting the wound roll with the said at least one pre-tensioned continuous loop and at least one winding roll located therein.

* * * * *